US007237458B2

(12) United States Patent
Shiao

(10) Patent No.: US 7,237,458 B2
(45) **Date of Patent: *Jul. 3, 2007**

(54) RATCHET SCREWDRIVER WITH A REPLACEABLE BIT MAGAZINE UNIT

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/217,630

(22) Filed: Aug. 31, 2005

(65) Prior Publication Data

US 2006/0225537 A1 Oct. 12, 2006

(30) Foreign Application Priority Data

Apr. 11, 2005 (TW) ..... 94111321 A

(51) Int. Cl.
*B25B 13/46* (2006.01)
*B25G 1/08* (2006.01)

(52) U.S. Cl. ..... 81/62; 81/439; 81/490

(58) Field of Classification Search ..... 81/62, 81/63.1, 490, 177.4, 438, 439
See application file for complete search history.

(56) References Cited

U.S. PATENT DOCUMENTS

| | | | | |
|---|---|---|---|---|
| 6,134,995 | A * | 10/2000 | Shiao | 81/439 |
| 6,196,093 | B1 * | 3/2001 | Hu | 81/490 |
| 6,502,484 | B2 * | 1/2003 | Pao-Hsi | 81/439 |
| 6,601,483 | B2 * | 8/2003 | Wannop | 81/490 |
| 6,658,970 | B2 * | 12/2003 | Shiao | 81/62 |
| 7,000,509 | B2 * | 2/2006 | Shiao | 81/490 |
| 7,039,975 | B1 * | 5/2006 | Liao | 81/490 |
| 7,107,876 | B1 * | 9/2006 | Chen | 81/63.1 |

* cited by examiner

*Primary Examiner*—Hadi Shakeri
(74) *Attorney, Agent, or Firm*—Christie, Parker & Hale, LLP

(57) ABSTRACT

A ratchet screwdriver includes a screwdriver body, a magazine body journalled and disposed removably within the screwdriver body for receiving a plurality of bits, and a ratchet unit disposed on a front end of the screwdriver body. A driving rod is movable in the screwdriver body between a front limit position, where a selected one of the bits projects from the ratchet unit for performing a screw driving operation, and a rear limit position, where the magazine body can be removed from the screwdriver body.

11 Claims, 19 Drawing Sheets

RATCHET SCREWDRIVER WITH A REPLACEABLE BIT MAGAZINE UNIT

CROSS-REFERENCE TO RELATED APPLICATION

This application claims priority of Taiwanese Application No. 094111321, filed on Apr. 11, 2005.

BACKGROUND OF THE INVENTION

1. Field of the Invention

This invention relates to a hand tool, and more particularly to a ratchet screwdriver that includes a replaceable bit magazine unit.

2. Description of the Related Art

Referring to FIGS. 1 and 2, a conventional screwdriver includes a screwdriver body 1, a sliding unit 2 disposed movably in the screwdriver body 1, a controlling member 3 operable to move the sliding unit 2 in the screwdriver body 1 along a straight path, a handle 4 disposed fixedly on the screwdriver body 1 and located behind the controlling member 3, and a bit magazine 5 journalled in the screwdriver body 1. The screwdriver body 1 includes a shaft seat 101 and a circular tube 102 connected fixedly to a rear end of the shaft seat 101. The shaft seat 101 has an annular outer surface that is formed with a recess 103. The circular tube 102 is formed with two open-ended axial slots 104. The sliding unit 2 includes a hook rod 201 and a guiding block 202. The hook rod 201 includes a hook portion 201' disposed at a front end thereof, and an integral stub 203 disposed at a rear end thereof and extending through a hole 204 in the guiding block 202. A C-shaped retaining ring 205 is received within an annular groove 206 in the stub 203 so as to retain the guiding block 202 on the hook rod 201. The guiding block 202 is formed with two guiding rod portions 202' at two opposite ends thereof, which extend respectively through the axial slots 104 in the circular tube 102. The bit magazine 5 is journalled within the recess 103 in the shaft seat 101 by a shaft 7, and has an annular outer surface that is formed with a plurality of bit slots 501 for receiving respectively a plurality of screwdriver bits 6 (only one is shown in FIG. 1) therein. Each of the bits 6 has an annular outer surface that is formed with an annular groove 601. The controlling member 3 can be rotated in a direction to move the sliding unit 2 rearwardly in the screwdriver body 1. When the sliding unit 2 moves to its rear limit position, the hook portion 201' engages the annular groove 601 in a selected one of the bits 6. Subsequently, the controlling member 3 can be rotated in an opposite direction to move the sliding unit 2 forwardly. When the sliding unit 2 moves to its front limit position, the selected bit 6 projects from the screwdriver body 1 for performing a screw driving operation. The bit magazine 5 can be rotated manually within the screwdriver body 1 to change the bit 6 to be moved by the sliding unit 2.

The aforesaid conventional screwdriver suffers from the following disadvantages:

1. The bit magazine 5 cannot be removed from the screwdriver body 1 for replacement.

2. The bits 6 are put respectively into the bit slots 501 in the bit magazine 5 in a radial direction of the bit magazine 5. As such, the bits 6 are apt to become dislodged from the bit slots 501.

3. To allow for operation by the sliding unit 2, it is necessary for the bits 6 to be formed with the annular grooves 601. Current screwdriver bits are not suitable for use with said conventional screwdriver because they are not provided with annular grooves.

4. To perform a screw driving operation, the controlling member 3 must be rotated to move the sliding unit 2 in the screwdriver body 1. This results in a troublesome operation.

5. The conventional screwdriver is not provided with a ratchet unit.

SUMMARY OF THE INVENTION

The object of this invention is to provide a ratchet screwdriver that is capable of overcoming the abovementioned disadvantages associated with the prior art.

According to this invention, a ratchet screwdriver includes a screwdriver body, a magazine body journalled and disposed removably within the screwdriver body for receiving a plurality of bits, and a ratchet unit disposed on a front end of the screwdriver body. A driving rod is movable in the screwdriver body between a front limit position, where a selected one of the bits projects from the ratchet unit for performing a screw driving operation, and a rear limit position, where the magazine body can be removed from the screwdriver body.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
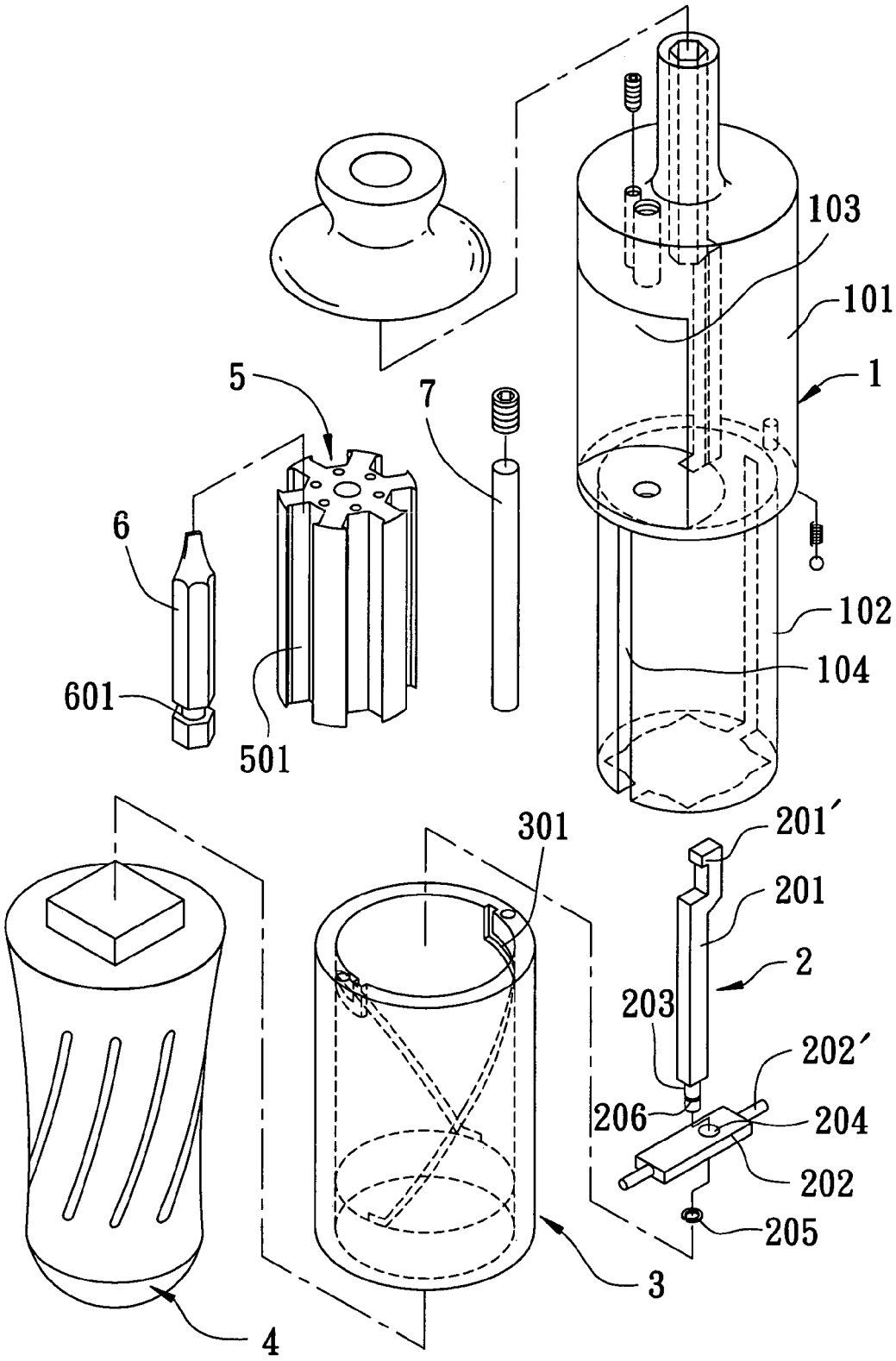
FIG. 1 PRIOR ART
FIG. 1 is an exploded perspective view of a conventional screwdriver that includes a bit magazine.
Figure 2:
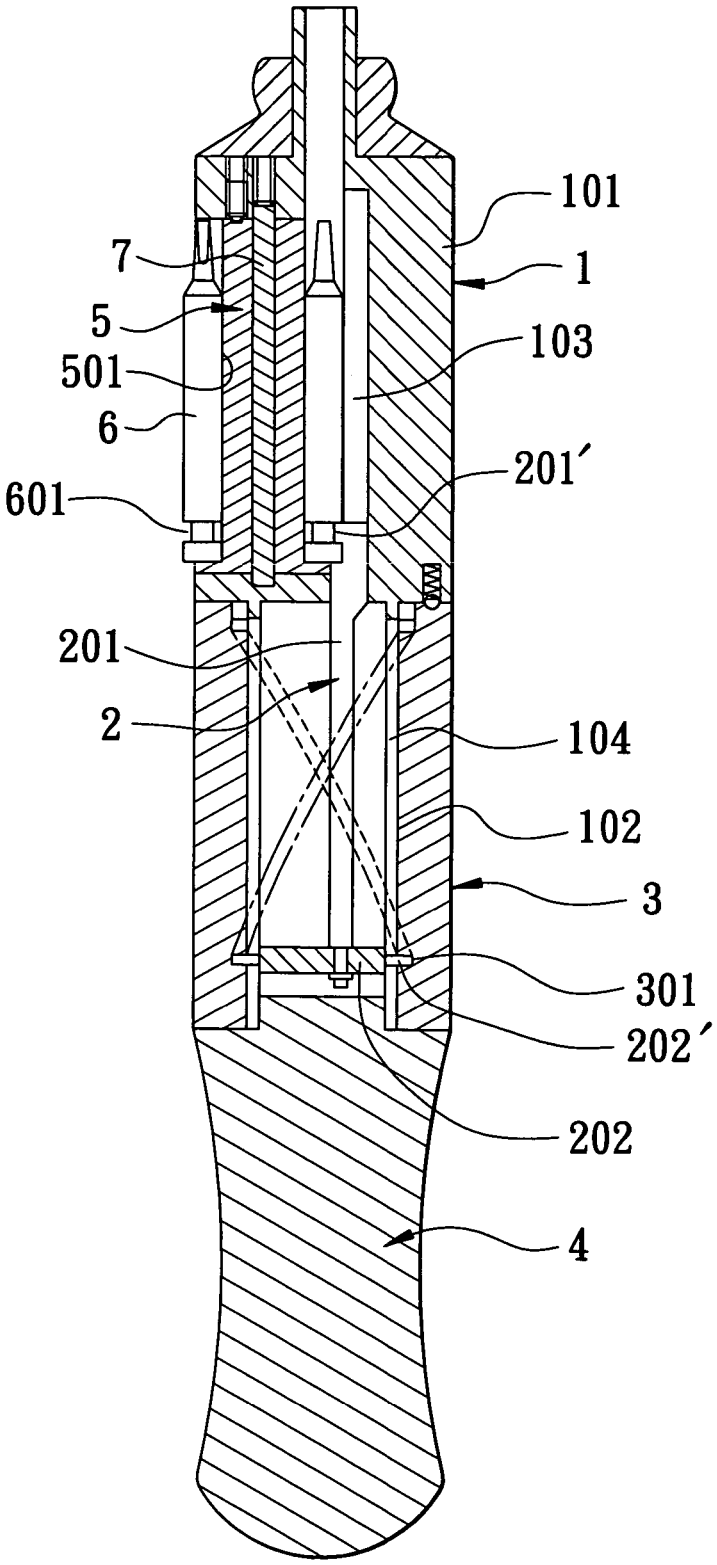
FIG. 2 PRIOR ART
FIG. 2 is a sectional view of the conventional screwdriver.

Before the present invention is described in greater detail in connection with the preferred embodiments, it should be noted that similar elements and structures are designated by like reference numerals throughout the entire disclosure.

Figure 3:
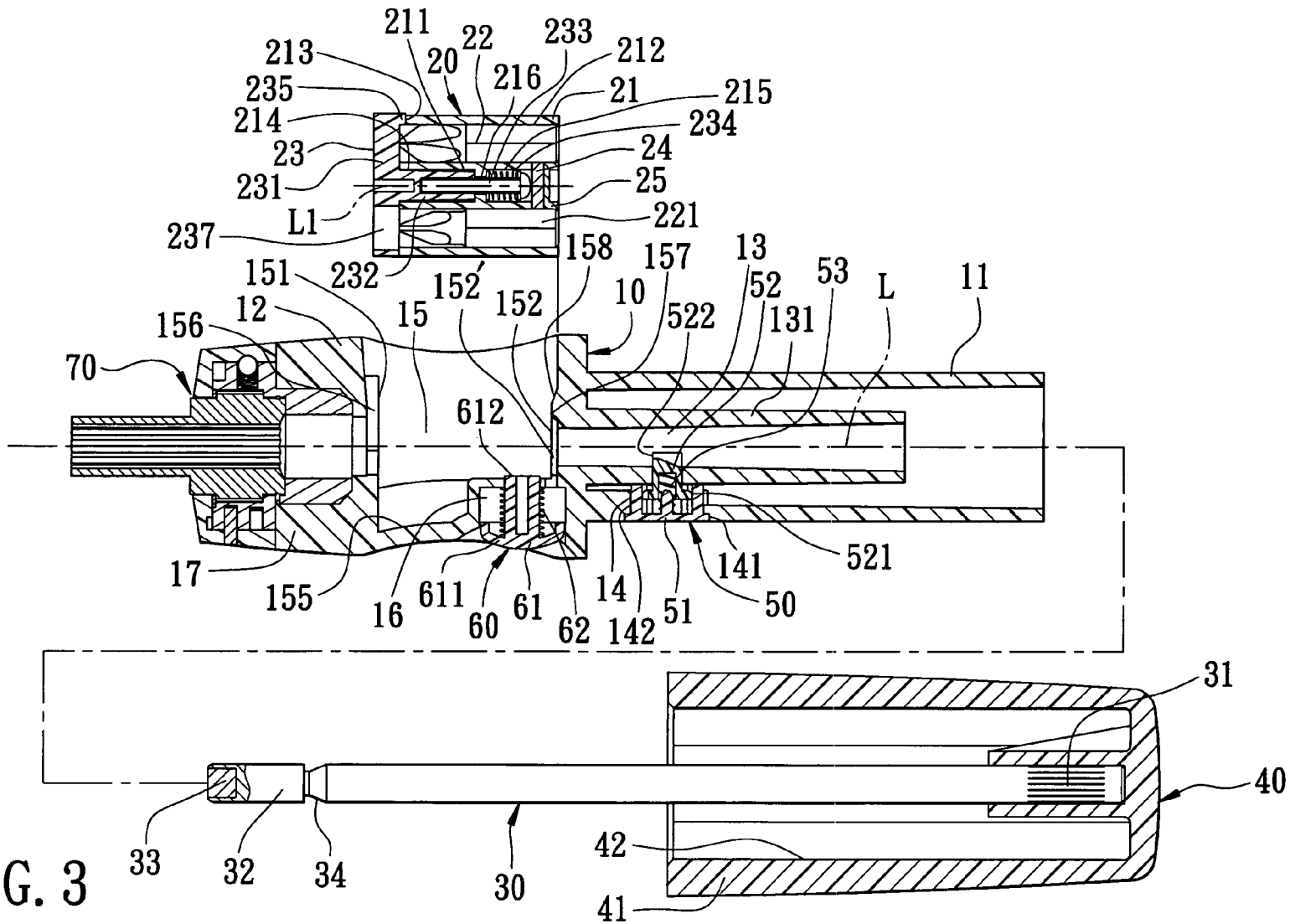
FIG. 3 is a partly exploded, sectional view of the first preferred embodiment of a ratchet screwdriver according to this invention.
Figure 4:
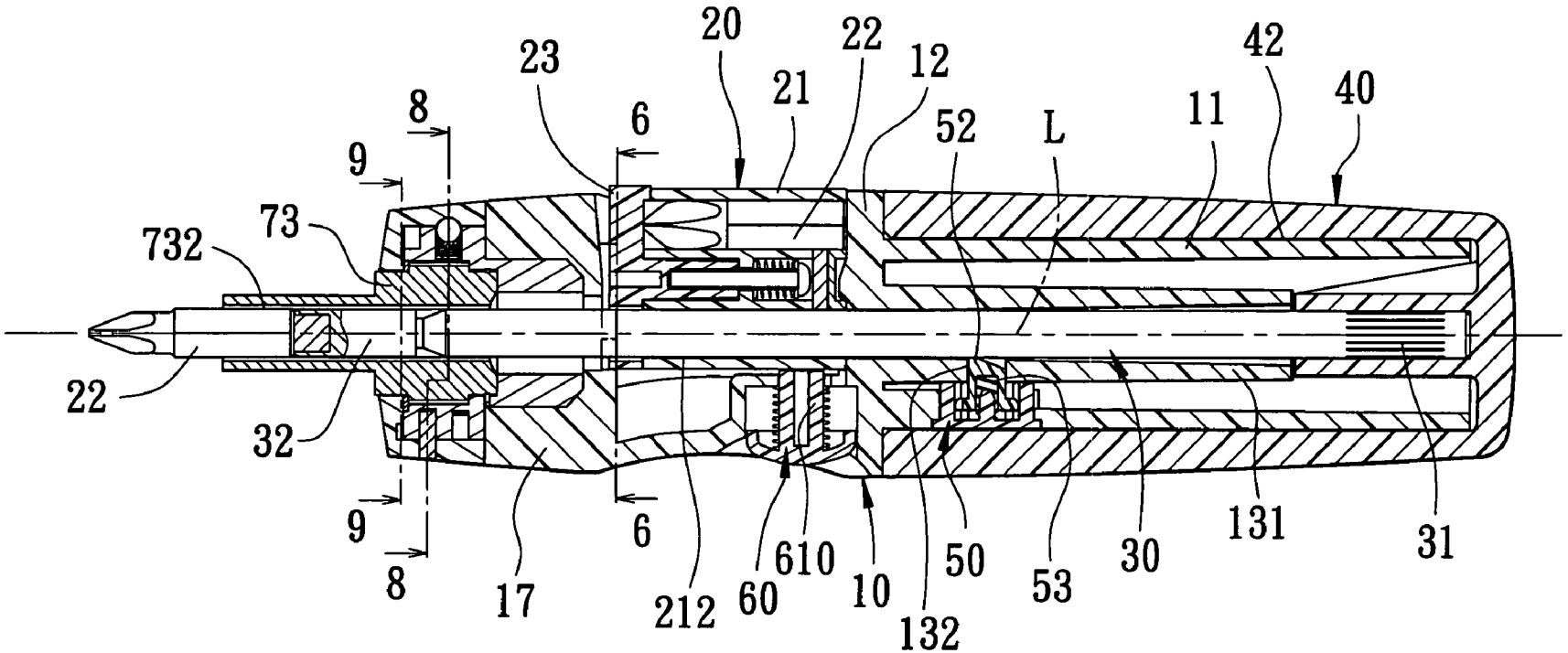
FIG. 4 is a sectional view of the first preferred embodiment, illustrating a front limit position of a driving rod.

Referring to FIGS. 3 and 4, the first preferred embodiment of a ratchet screwdriver according to this invention includes a screwdriver body 10, a replaceable bit magazine unit 20, a driving rod 30, a handle 40, a rod-positioning unit 50, a pushbutton unit 60 and a ratchet unit 70.

Figure 6:
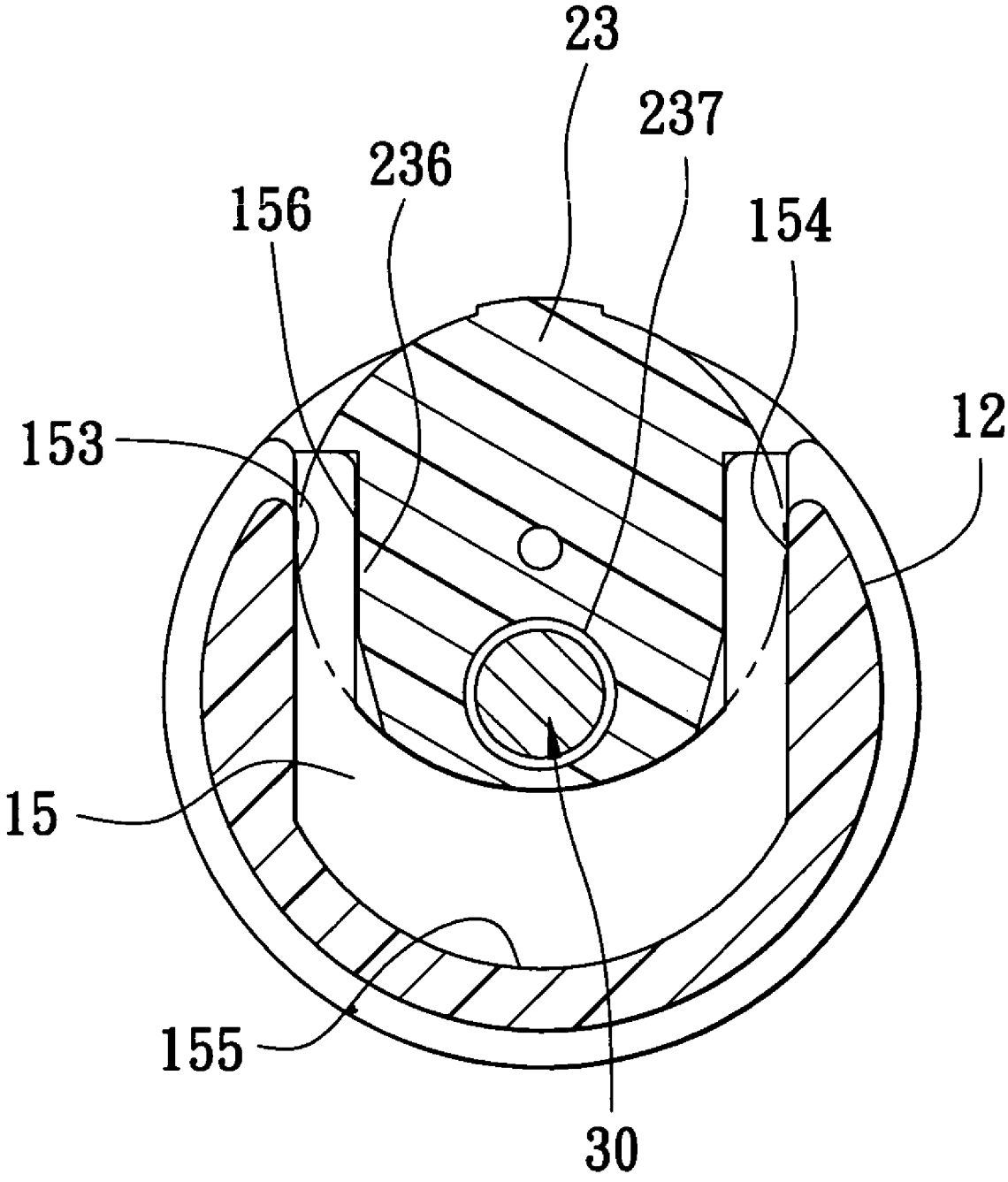
FIG. 6 is a sectional view taken along line 6-6 in FIG. 4.
Figure 16:
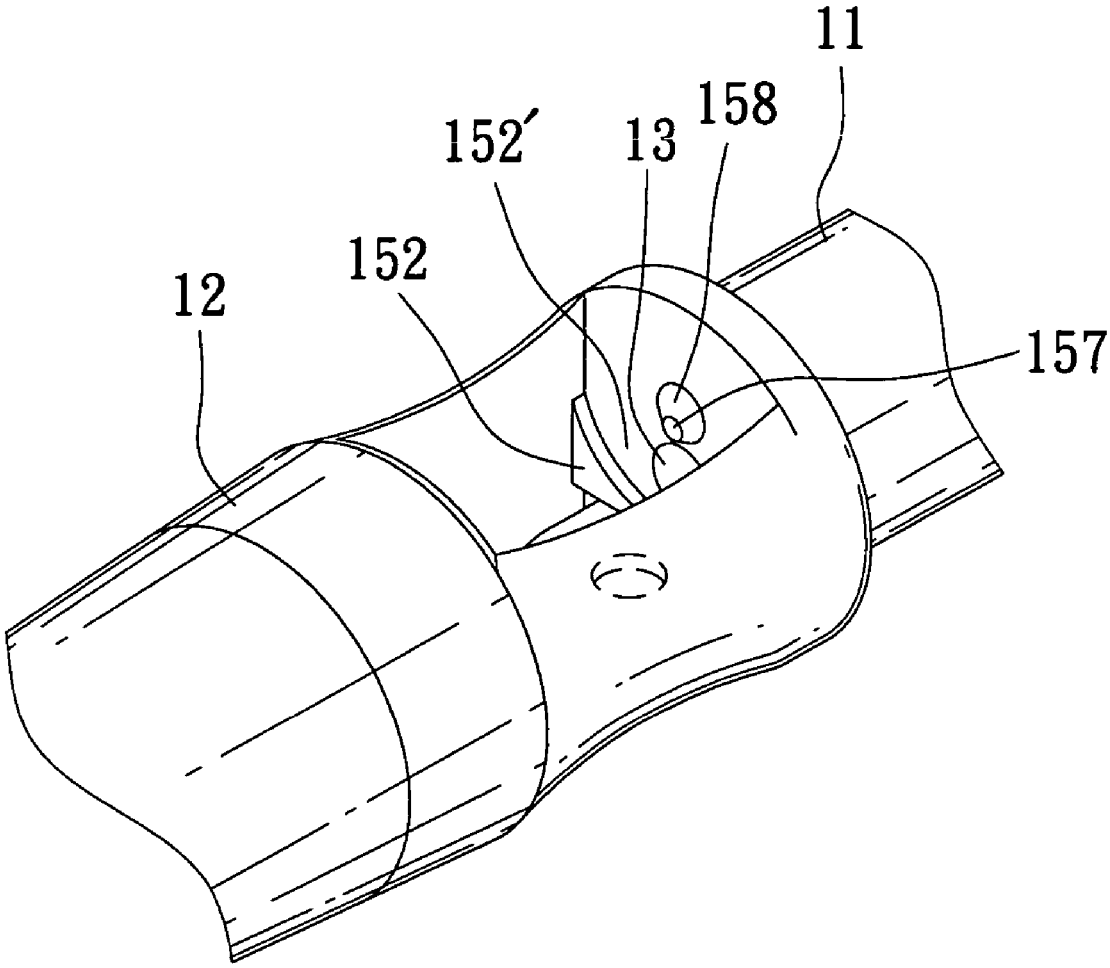
FIG. 16 is a fragmentary perspective view of the magazine body of the first preferred embodiment.

The screwdriver body 10 extends along a screwdriver axis (L), and includes a hexagonal guide tube 11 disposed at a rear end thereof, a front seat 12 formed integrally with and disposed in front of the guide tube 11, and an axial hole 13 defined by an inner tube 131 disposed within the guide tube 11. The inner tube 131 is formed integrally with the front seat 12, and extends along the screwdriver axis (L). The axial hole 13 extends into the front seat 12. The guide tube 11 has a wall that is formed with a radial counterbore 14. The front seat 12 has an annular outer surface that is formed with a magazine-accommodating space 15 and a through hole 16. The front seat 12 also has a front end portion 17. The magazine-accommodating space 15 is communicated with the axial hole 13, and is disposed in front of the guide tube 11. With further reference to FIGS. 6 and 16, the magazine-accommodating space 15 is defined by a pair of front and rear side surfaces 151, 152 perpendicular to the screwdriver axis (L), a pair of left and right side surfaces 153, 154 parallel to the screwdriver axis (L), and a curved bottom surface 155. The front side surface 151 is formed with an open-ended guide slot 156. The rear side surface 152 is formed with a recess 152' and a protrusion 157 that has an inclined guiding surface 158.

Figure 5:
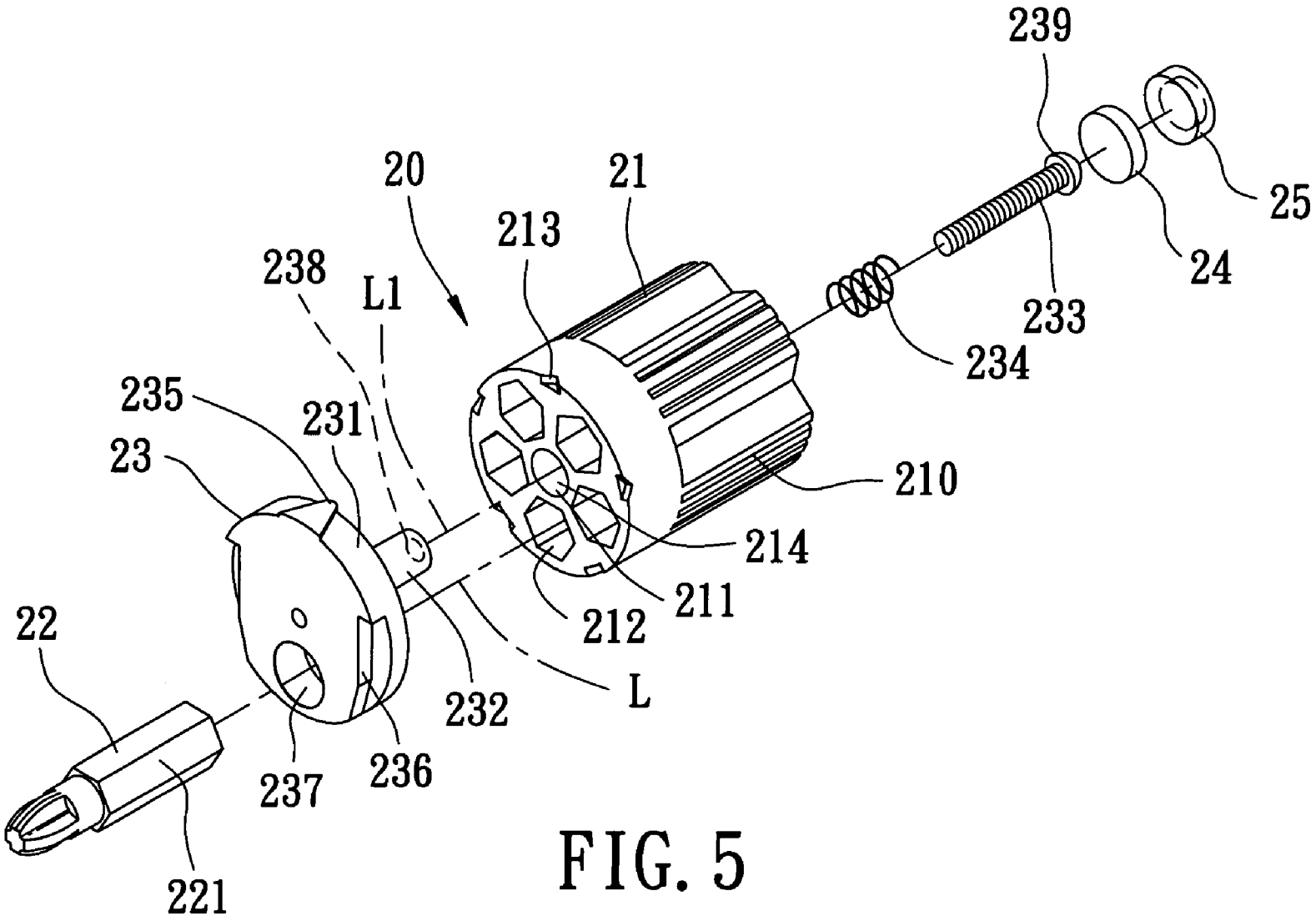
FIG. 5 is an exploded perspective view of a bit magazine unit of the first preferred embodiment.

With additional reference to FIG. 5, the bit magazine unit 20 is disposed removably within the magazine-accommodating space 15 in the screwdriver body 10. The bit magazine unit 20 includes a magazine body 21, a plurality of screwdriver bits 22, a shaft seat 23, a magnet 24 and an end plug 25.

The magazine body 21 has an axially extending central hole 211 extending along a magazine axis (L1) parallel to the screwdriver axis (L), a plurality of axially extending bit slots 212 arranged along a circumferential direction of the magazine body 21 and disposed around the central hole 211, and a plurality of angularly equidistant positioning grooves 213 formed along an outer periphery of a front end surface of the magazine body 21. The central hole 211 and the bit slots 212 are formed through the magazine body 21. The magazine body 21 is formed with a flange 216 extending radially and inwardly therefrom. As such, the central hole 211 is divided into a front hole portion 214 disposed in front of the flange 216, and a rear hole portion 215 disposed behind the flange 216.

The bits 22 are received respectively within the bit slots 212 in the magazine body 21. Each of the bits 22 has a hexagonal cross-sectioned rear end 221.

The shaft seat 23 includes a disc portion 231, a shaft rod 232, a bolt 233 and a coiled compression spring 234. The disc portion 231 is perpendicular to the screwdriver axis (L) and the magazine axis (L1), and has a positioning projection 235 formed on an annular outer surface thereof, a retaining portion 236 formed on a front side surface thereof and engaging fittingly the guide slot 156 in the screwdriver body 10, and a bit hole 237 formed therethrough and extending along the screwdriver axis (L). The shaft rod 232 extends integrally and rearwardly from a central portion of the disc portion 231 into the front hole portion 214 of the central hole 211 in the magazine body 21 along the magazine axis (L), and has a rear end surface that is formed with a threaded hole 238. The bolt 233 engages the threaded hole 238 in the shaft rod 232, and has a head 239 disposed at a rear end of the bolt 233 and in the rear hole portion 215 of the central hole 211 in the magazine body 21. The coiled compression spring 234 is sleeved on the bolt 233 between the flange 216 and the head 239 of the bolt 233. As such, the positioning projection 235 of the disc portion 231 is biased by the coiled compression spring 234 to engage a selected one of the positioning grooves 213 in the magazine body 21.

The magnet 24 is disposed in the rear hole portion 215 of the central hole 211 in the magazine body 21 behind the bolt 233 so as to magnetically attract the bits 22 disposed within the bit slots 212 in the magazine body 21, thereby confining the bits 22 within the magazine body 21.

The end plug 25 is shaped as a hollow cylinder, and is press fitted within a rear end of the central hole 211 in the magazine body 21 so as to confine the magnet 24 within the central hole 211. The protrusion 157 of the screwdriver body 10 engages the rear end of the central hole 211 so as to confine the magazine body 21 within the magazine-accommodating space 15. As such, the magazine body 21 is journalled within the magazine-accommodating space 15 in the screwdriver body 10 by the shaft rod 232 and the protrusion 157. During assembly, the inclined guiding surface 158 can facilitate engagement between the central hole 211 in the magazine body 21 and the protrusion 157.

The driving rod 30 extends along the screwdriver axis (L), and is movable axially within the axial hole 13 in the screwdriver body 10. The driving rod 30 includes a driving end 31 projecting rearwardly from the guide tube 11, a bit-coupling end 32 opposite to the driving end 31, a magnetically attracting member 33 disposed fixedly on the bit-coupling end 32 and attached magnetically to the rear end 221 of the selected bit 22, an annular positioning groove 34 disposed in proximity to the bit-coupling end 32, and a frustoconical rod portion 35 (see FIG. 10) defining a rear portion of the positioning groove 34.

The handle 40 is coupled fixedly to the driving end 31, and has a surrounding wall 41 disposed around the screwdriver axis (L), and a hexagonal hole 42 defined by the surrounding wall 41 and engaging fittingly the guide tube 11 of the screwdriver body 10. This allows for axial movement of the handle 40 relative to the screwdriver body 10 along the screwdriver axis (L) while preventing rotation of the handle 40 relative to the screwdriver body 10.

Figure 17:
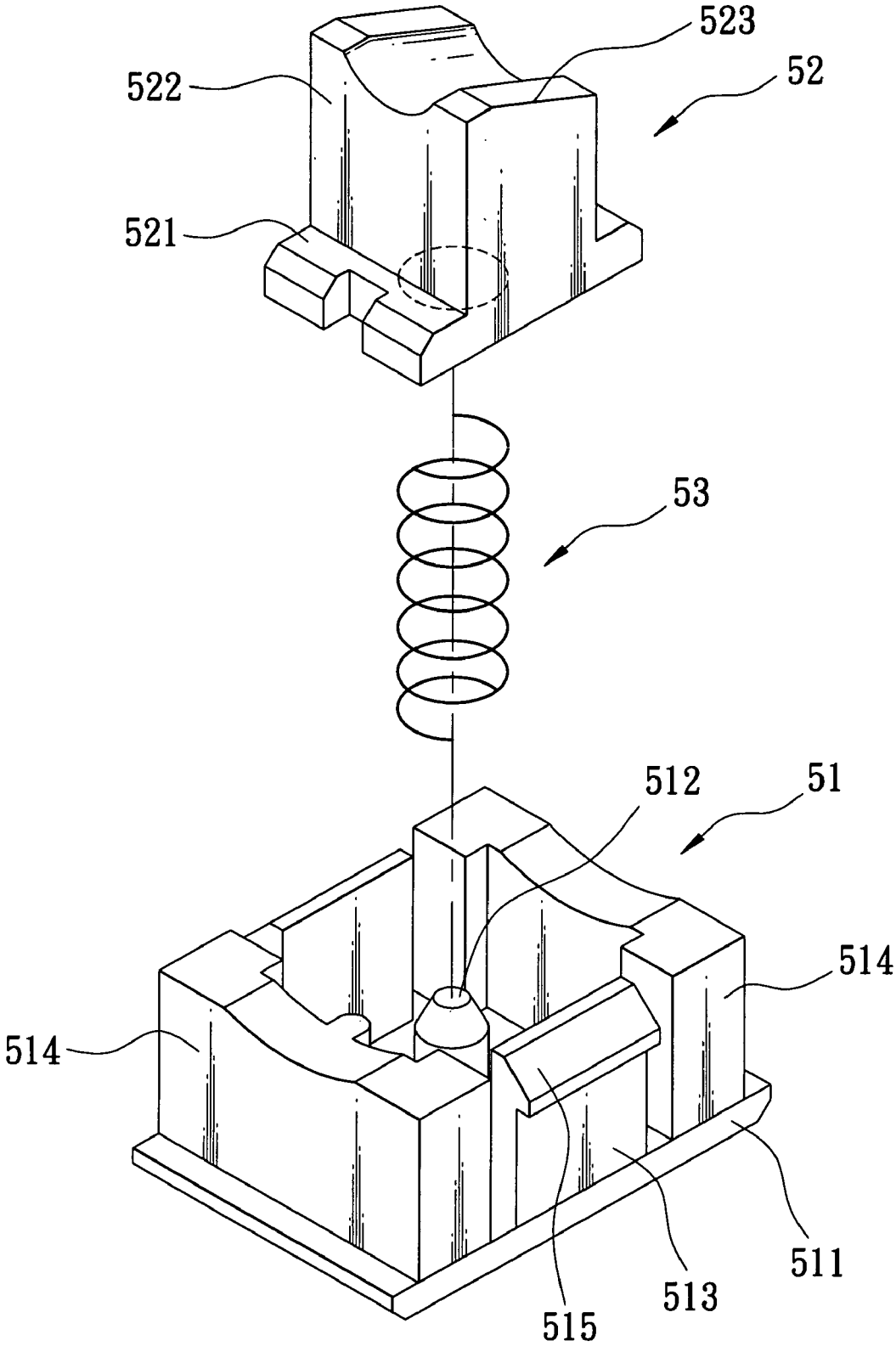
FIG. 17 is an exploded perspective view of a fixed block, a positioning retainer and a coiled compression spring of the first preferred embodiment.

With additional reference to FIG. 17, the rod-positioning unit 50 is disposed within the counterbore 14 in the guide tube 11, and includes a fixed block 51, a positioning retainer 52 and a coiled compression spring 53. The fixed block 51 includes a base plate 511 fitted within a wide bore portion 141 (see FIG. 3) of the counterbore 14 in the guide tube 11. The base plate 511 has a side surface that is formed with a projecting rod 512 extending integrally from the center thereof, two aligned retaining arms 513 extending through a narrow bore portion 142 (see FIG. 3) of the counterbore 14, and two limiting walls 514 also extending through the narrow bore portion 142. Each of the retaining arms 513 has a barb end 515 (not shown in FIG. 3) disposed outwardly of the narrow bore portion 142 and abutting against an inner wall of the guide tube 11. Thus, the fixed block 51 is fixed on the guide tube 11. The positioning retainer 52 has an abutment plate portion 521 and an insert block 522 that are formed integrally with each other. The insert block 522 extends through a hole 132 in the inner tube 131, and is formed with an inclined surface 523. The abutment plate portion 521 cannot move into the hole 132 in the inner tube 131. The coiled compression spring 53 is sleeved on the projecting rod 512 of the fixed block 51 between the positioning retainer 52 and the base plate 511. Thus, the positioning retainer 52 is biased by the compression spring 53 to move away from the fixed block 51 toward the screwdriver axis (L).

Figure 12:
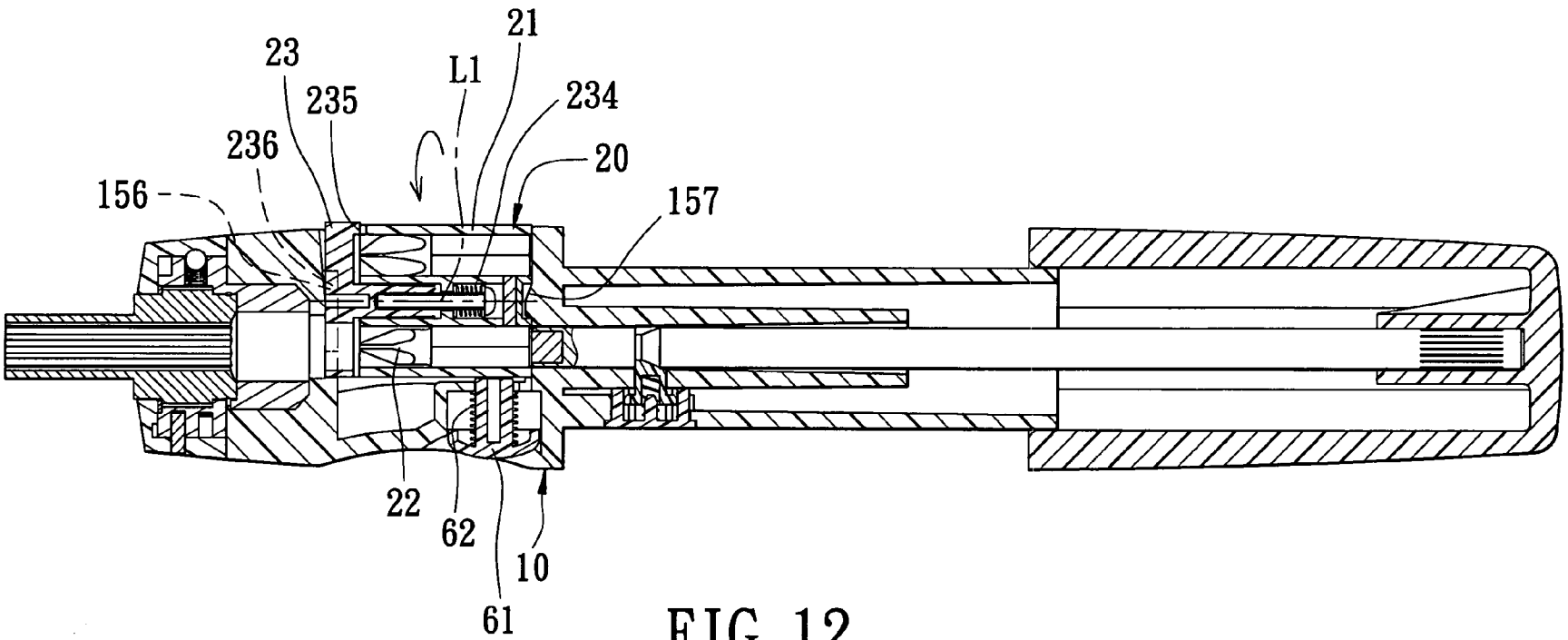
FIG. 12 is a sectional view of the first preferred embodiment, illustrating how the magazine body is rotated about a shaft rod and how a pushing block of a pushbutton unit is disposed at a release position.
Figure 14:
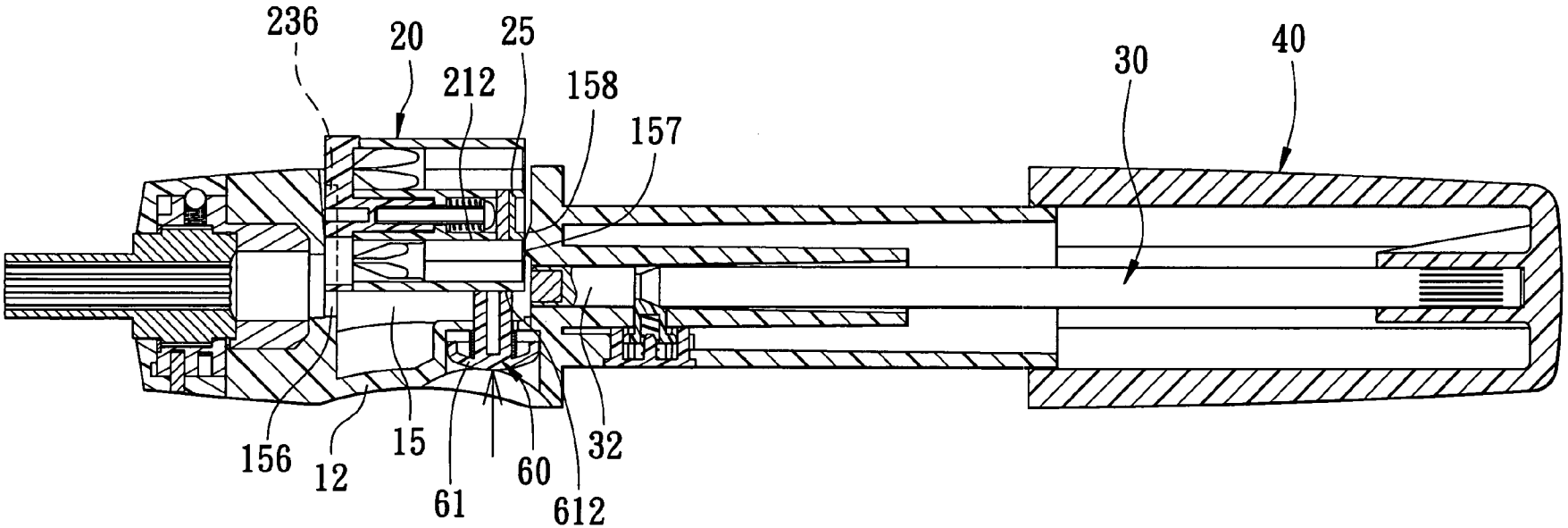
FIG. 14 is a sectional view of the first preferred embodiment, illustrating a pushing position of the pushing block of the pushbutton unit.
Figure 18:
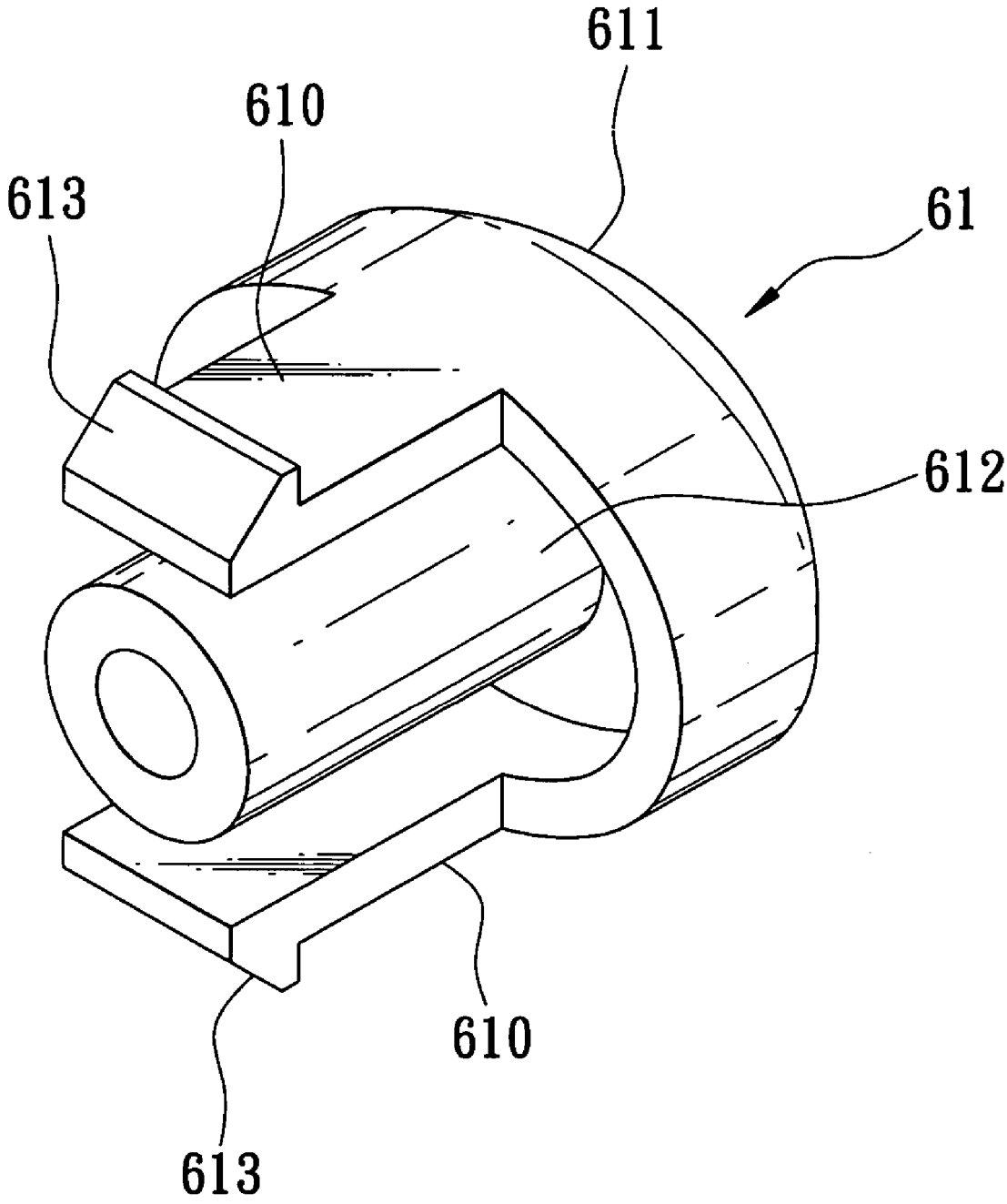
FIG. 18 is a perspective view of a pushing block of the first preferred embodiment.

With additional reference to FIG. 18, the pushbutton unit 60 is disposed within the through hole 16 in the screwdriver body 10, and includes a pushing block 61 and a coiled compression spring 62. The pushing block 61 extends through the through hole 16, and includes an actuation portion 611, two retaining arms 610 extending from the actuation portion 611, and a push rod 612 extending from the actuation portion 611 and disposed between the retaining arms 610. Each of the retaining arms 610 has an inner end that is formed with a barb 613, which is disposed outwardly of the through hole 16 and which is movable to abut against an inner wall of the front seat 12 so as to prevent removal of the pushing block 61 from the through hole 16. The coiled compression spring 62 is sleeved on the retaining arms 610 between the inner wall of the front seat 12 and the plate portion 611. Thus, the pushing block 61 is biased by the coiled compression spring 62 to move away from the screwdriver axis (L). As such, the pushing block 61 is movable between a release position shown in FIG. 12 and a pushing position shown in FIG. 14. In the pushing position, the bit magazine unit 20 is ejected from the magazine-accommodating space 15 by the pushing block 61. In the release position, the pushing block 61 is removed from the magazine body 21 (i.e., provides no biasing force thereto) by the coiled compression spring 62.

Figure 7:
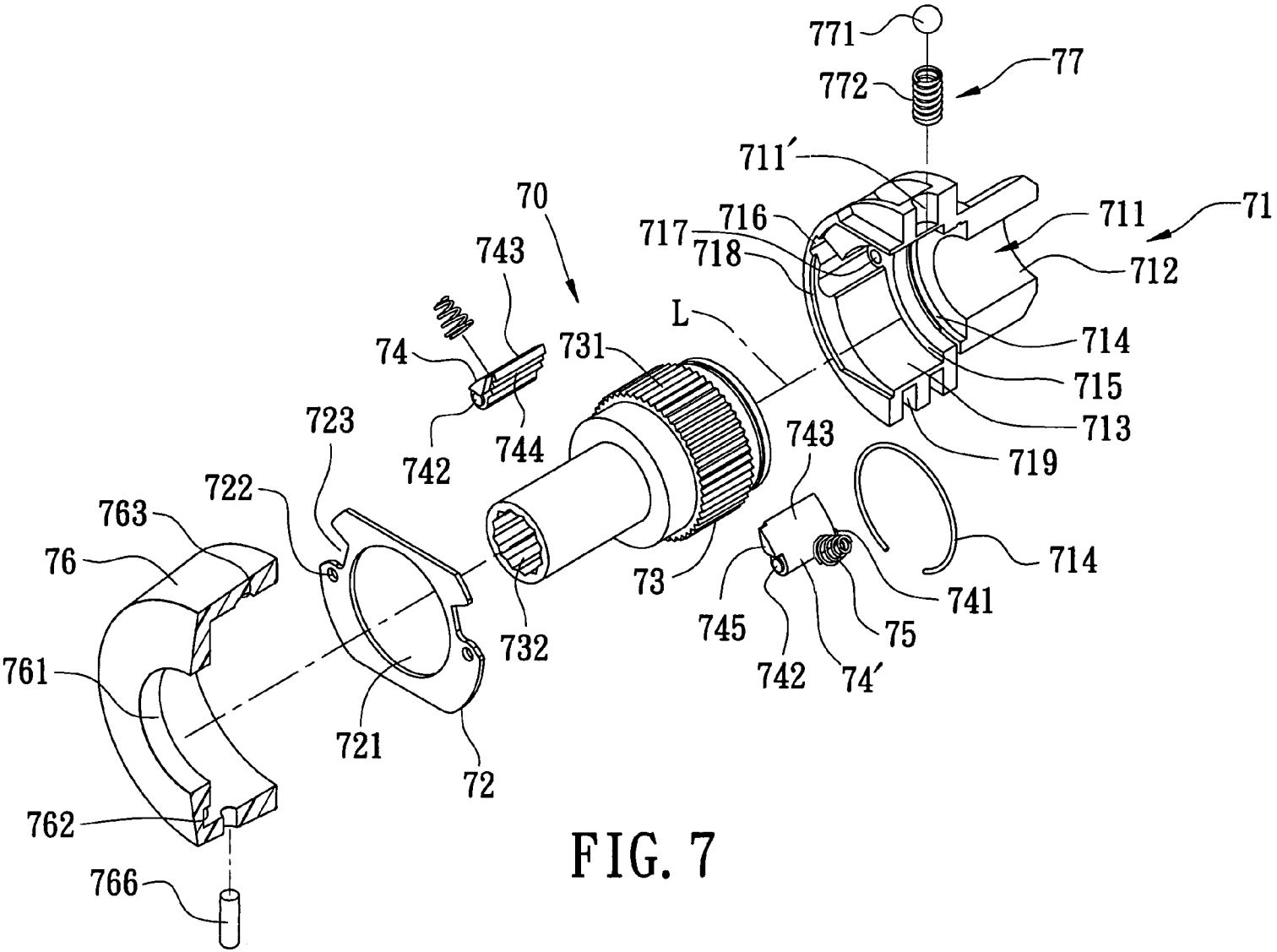
FIG. 7 is a partly sectional, exploded perspective view of a ratchet unit of the first preferred embodiment.

With additional reference to FIG. 7, the ratchet unit 70 is disposed on the front end portion 17 of the screwdriver body 10. The ratchet unit 70 includes a positioning seat 71, a position-limiting plate 72, a ratchet wheel 73, a pair of first and second pawls 74, 74', two resilient members 75, a rotary cover 76 and a positioning unit 77. The positioning seat 71 is disposed fixedly within the front end portion 17, and has an axially extending stepped hole 711 formed therethrough and communicated with the axial hole 13, and a radial hole 711' formed in an annular outer surface of the positioning seat 71. The stepped hole 711 has a small-diameter portion 712 disposed in proximity to the magazine-accommodating space 15 in the front seat 12, a large-diameter portion 713 disposed in front of the small-diameter portion 712 and having a diameter greater than that of the small-diameter portion 712, and a middle portion 714 disposed between the small-diameter portion 712 and the large-diameter portion 713. The diameter of the middle portion 714 is greater than that of the small-diameter portion 712 but smaller than that of the large-diameter portion 713. The positioning seat 71 further has a shoulder 715 disposed between the large-diameter portion 713 and the middle portion 714. The positioning seat 71 is formed with two pawl-accommodating slots 716 communicated with the large-diameter portion 713 of the stepped hole 711. A C-shaped retaining ring 714' is fitted within the middle portion 714 of the stepped hole 711. The shoulder 715 is formed with two first pivot holes 717. A front end of the positioning seat 71 has a front end surface that is formed with a recess 718, and an annular outer surface that is formed with a limiting slot 719, which extends along a circumferential direction of the positioning seat 71 and which has two closed ends.

The position-limiting plate 72 is fitted within the recess 718 in the front end surface of the positioning seat 71, and has a through hole 721 aligned with the stepped hole 711, two second pivot holes 722 aligned respectively with the first pivot holes 717 in the shoulder 715 of the positioning seat 71, and two notches 723 disposed respectively in proximity to the second pivot holes 722.

The ratchet wheel 73 is disposed within the large-diameter portion 713 and the middle portion 714 of the stepped hole 711, and has two opposite ends journalled respectively within the retaining ring 714' and the through hole 721 in the position-limiting plate 72. As such, the ratchet wheel 73 is rotatable about the screwdriver axis (L). The ratchet wheel 73 has a plurality of ratchet teeth 731, and a polygonal bit-engaging hole 732 communicated with the magazine-accommodating space 15 in the front seat 12. When any of the bits 22 is received within the bit-engaging hole 732, it cannot rotate relative to the ratchet wheel 73.

Figure 8:
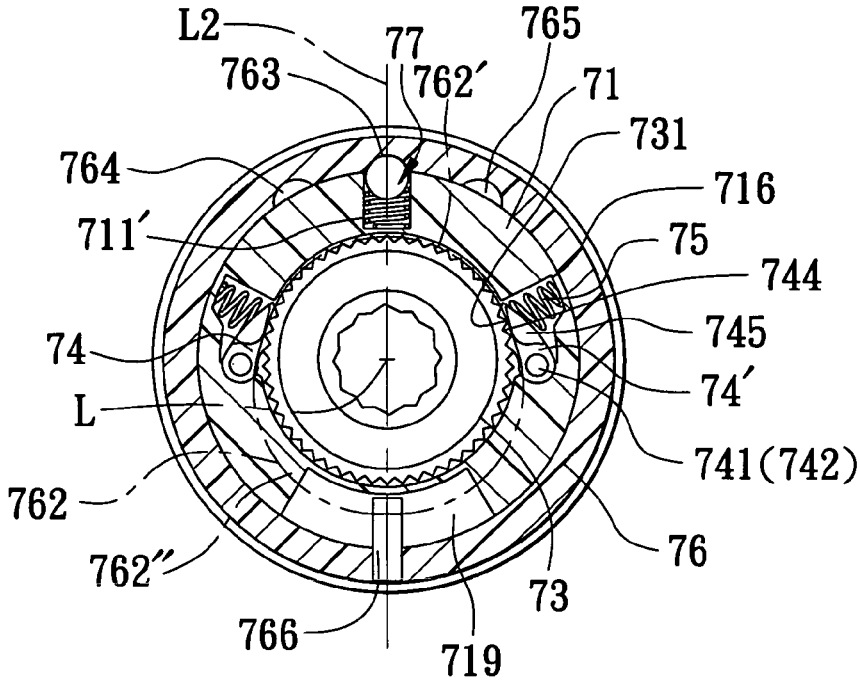
FIG. 8 is a sectional view taken along line 8-8 in FIG. 4.

With additional reference to FIG. 8, the first and second pawls 74, 74' are disposed respectively within the pawl-accommodating slots 716 in the positioning seat 71. Each of the first and second pawls 74, 74' includes an integral first pin 741 at a rear side thereof and disposed rotatably within the corresponding first pivot hole 717 in the shoulder 715 of the positioning seat 71, and an integral second pin 742 disposed at a front side thereof and disposed rotatably within the corresponding second pivot hole 722 in the position-limiting plate 72. The first and second pins 741, 742 of each of the first and second pawls 74, 74' are aligned with each other. Each of the first and second pawls 74, 74' has a free end 743 that is formed with a plurality of retaining teeth 744, and a projection 745 formed on the front side thereof.

The resilient members 75 are configured as coiled compression springs, and bias respectively the retaining teeth 744 of the first and second pawls 74, 74' toward the ratchet teeth 731 of the ratchet wheel 73.

Figure 9:
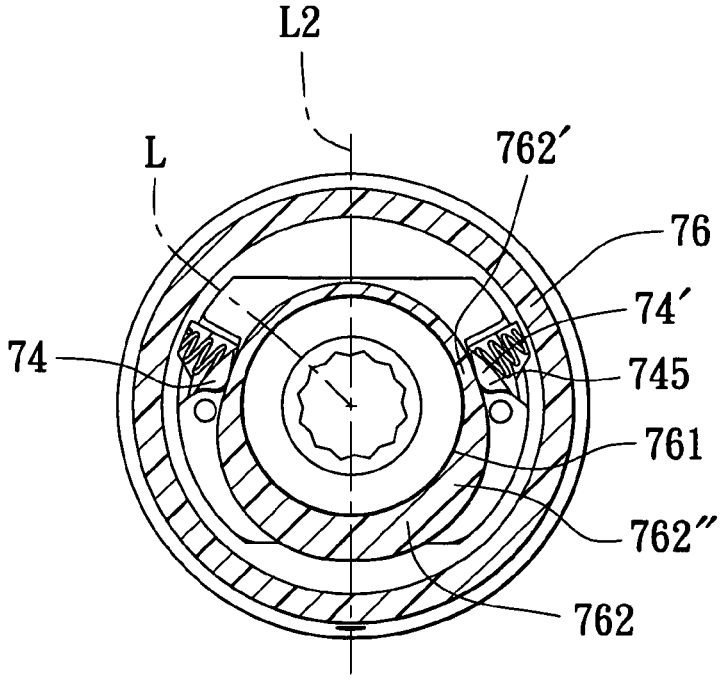
FIG. 9 is a sectional view taken along line 9-9 in FIG. 4.
Figure 15:
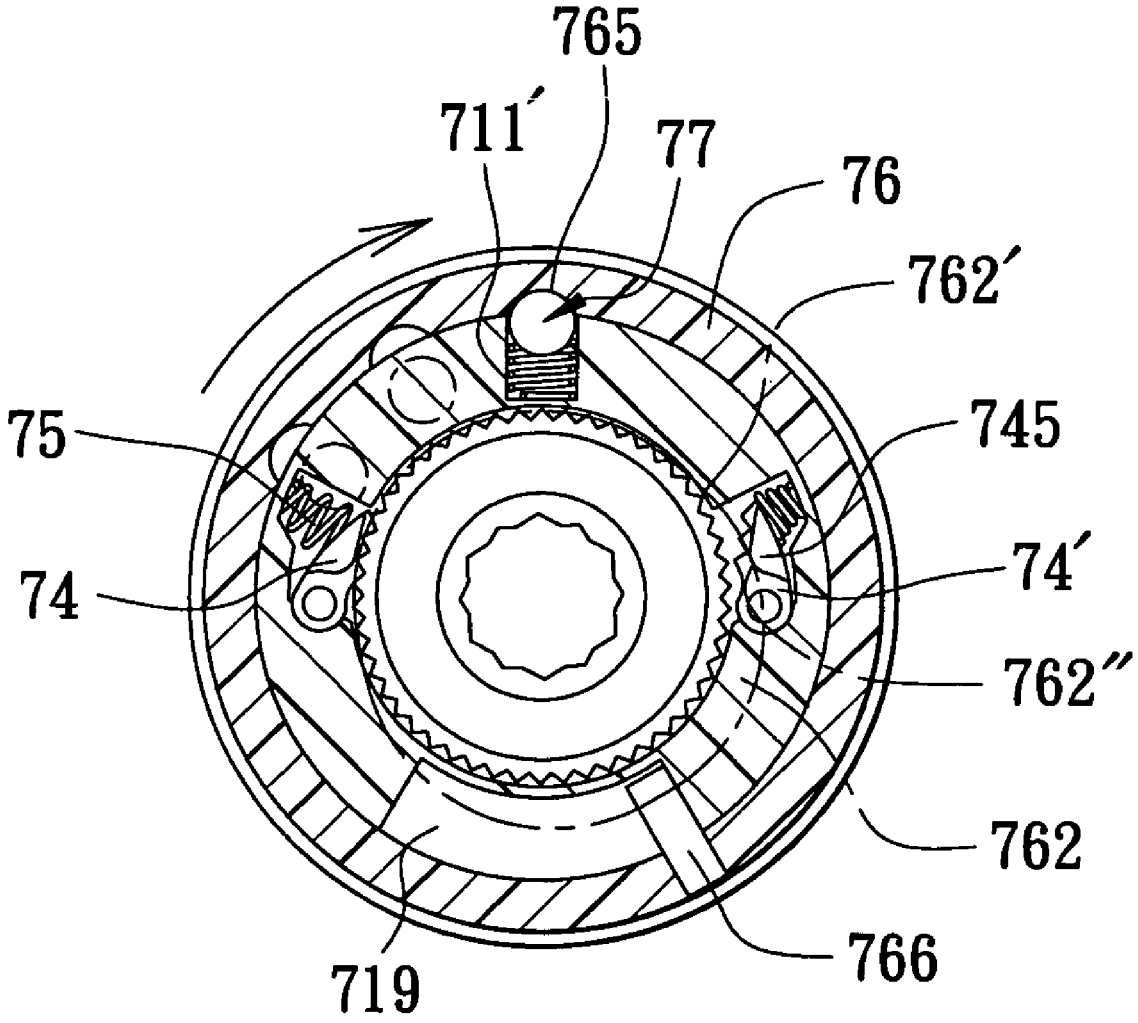
FIG. 15 is a sectional view of the first preferred embodiment, illustrating how a rotary cover is rotated clockwise so that a driving portion of the rotary cover moves a second pawl from an engagement position to a disengagement position.

With additional reference to FIG. 9, the rotary cover 76 is sleeved rotatably on the positioning seat 71 so as to retain the ratchet wheel 73, the first and second pawls 74, 74', and the first and second resilient members 75 on the positioning seat 71. A pin 766 is connected fixedly to the rotary cover 76, and is received within the limiting slot 719 in the positioning seat 71. This prevents linear movement of the rotary cover 76 relative to the positioning seat 71, while allows for rotational movement of the rotary cover 76 relative to the positioning seat 71. The rotary cover 76 includes a central hole 761, a driving portion 762, and first, second and third positioning holes 763, 764, 765. The driving portion 762 has an annular outer surface that is eccentric with respect to the screwdriver axis (L) and that is symmetric with respect to an axis (L2) of the first positioning hole 763, and has a release section 762' and a pushing section 762". The release section 762' is located nearer to the screwdriver axis (L) than the pushing section 762". The first positioning hole 763 is disposed between the second and third positioning holes 764, 765. The projection 745 of each of the first and second pawls 74, 74' is in slidable contact with the release section 762' or the pushing section 762" of the annular outer surface of the driving portion 762 of the rotary cover 76. Upon rotation of the rotary cover 76 on the positioning seat 71, the driving portion 762 can rotate each of the first and second pawls 74, 74' from an engagement position, where the retaining teeth 744 of a corresponding one of the first and second pawls 74, 74' engage the ratchet teeth 731 of the ratchet wheel 73, to a disengagement position shown in FIG. 15, where the retaining teeth 744 of the corresponding one of the first and second pawls 74, 74' are removed from the ratchet teeth 731 of the ratchet wheel 73.

The cover-positioning unit 77 is disposed within the radial hole 711' in the positioning seat 71, and includes a retainer 771 in the form of a ball, and a coiled compression spring 772 for biasing the retainer 771 to project from the radial hole 711' so as to engage a selected one of the first, second and third positioning holes 763, 764, 765.

When the retainer 771 engages the first positioning hole 763, the first and second pawls 74, 74' engage the ratchet wheel 73 so as to allow for co-rotation of the ratchet wheel 73 with the positioning seat 71 in either a clockwise or counterclockwise direction, as shown in FIG. 8.

When the retainer 771 engages the third positioning hole 765, the first pawl 74 engages the ratchet wheel 73, whereas the second pawl 74' separates from the ratchet wheel 73. As a result, the ratchet wheel 73 can co-rotate with the positioning seat 71 only in a clockwise direction, as shown by the arrow in FIG. 15.

Conversely, if the rotary cover 76 is rotated on the positioning seat 71 in a clockwise direction so as to engage the retainer 771 with the second positioning hole 764, the first pawl 74 will separate from the ratchet wheel 73, whereas the second pawl 74' will engage the ratchet wheel 23. This allows for co-rotation of the ratchet wheel 73 with the positioning seat 71 only in a counterclockwise direction.

Figure 10:
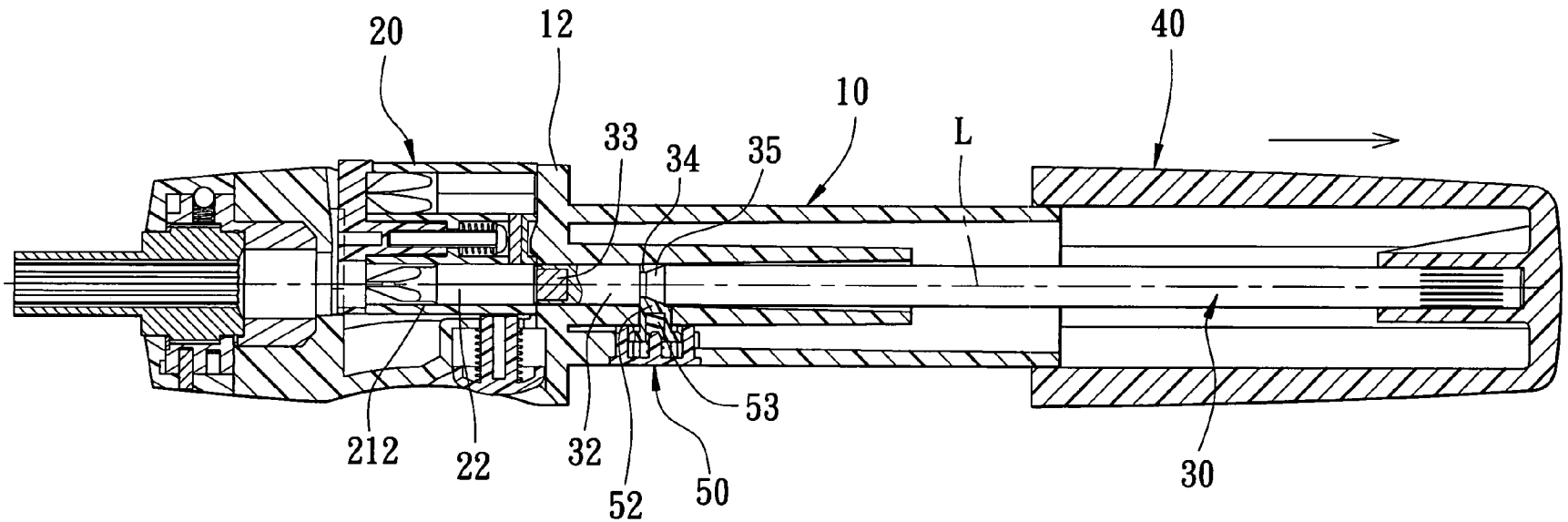
FIG. 10 is a sectional view of the first preferred embodiment, illustrating a rear limit position of the driving rod.
Figure 11:
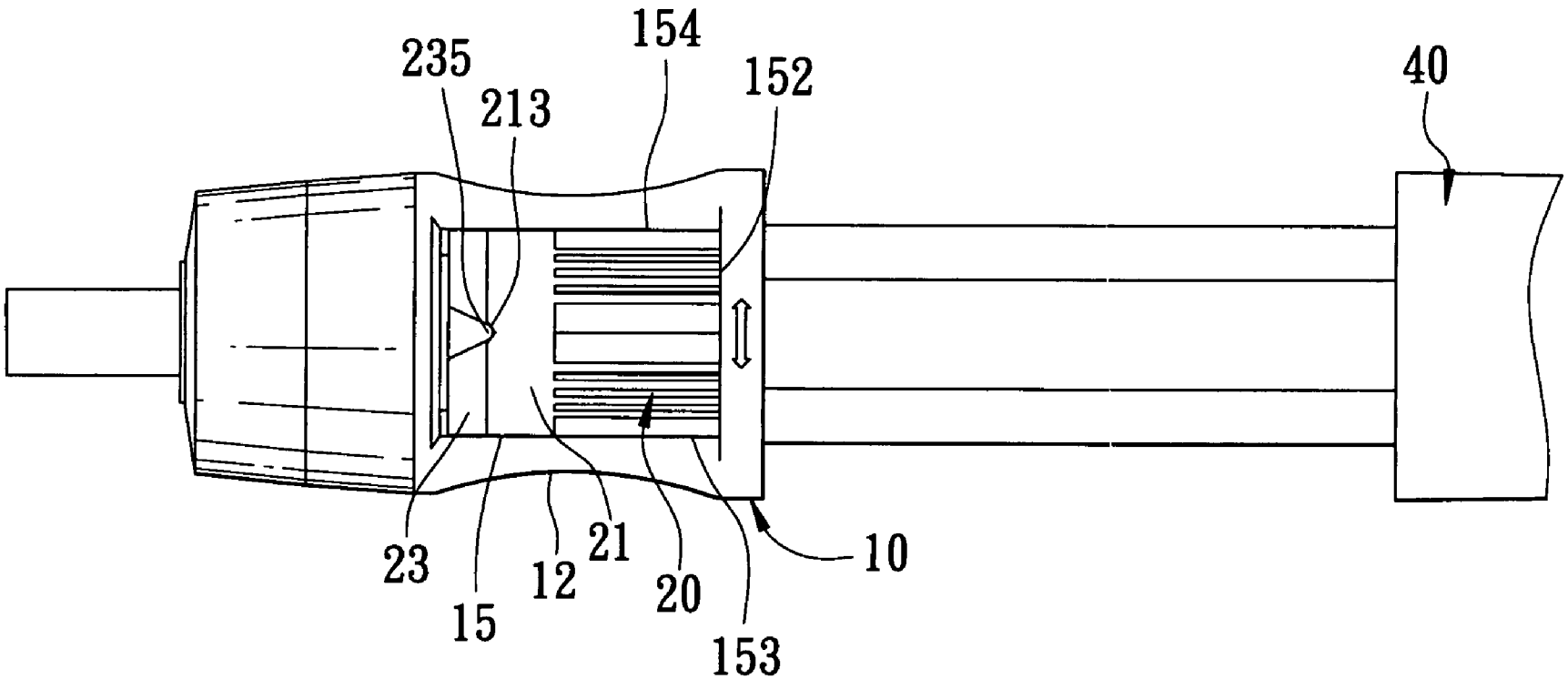
FIG. 11 is a fragmentary top view of the first preferred embodiment, illustrating how a magazine body is rotated to engage a positioning projection of a front seat with a selected one of positioning grooves in the magazine body.
Figure 13:
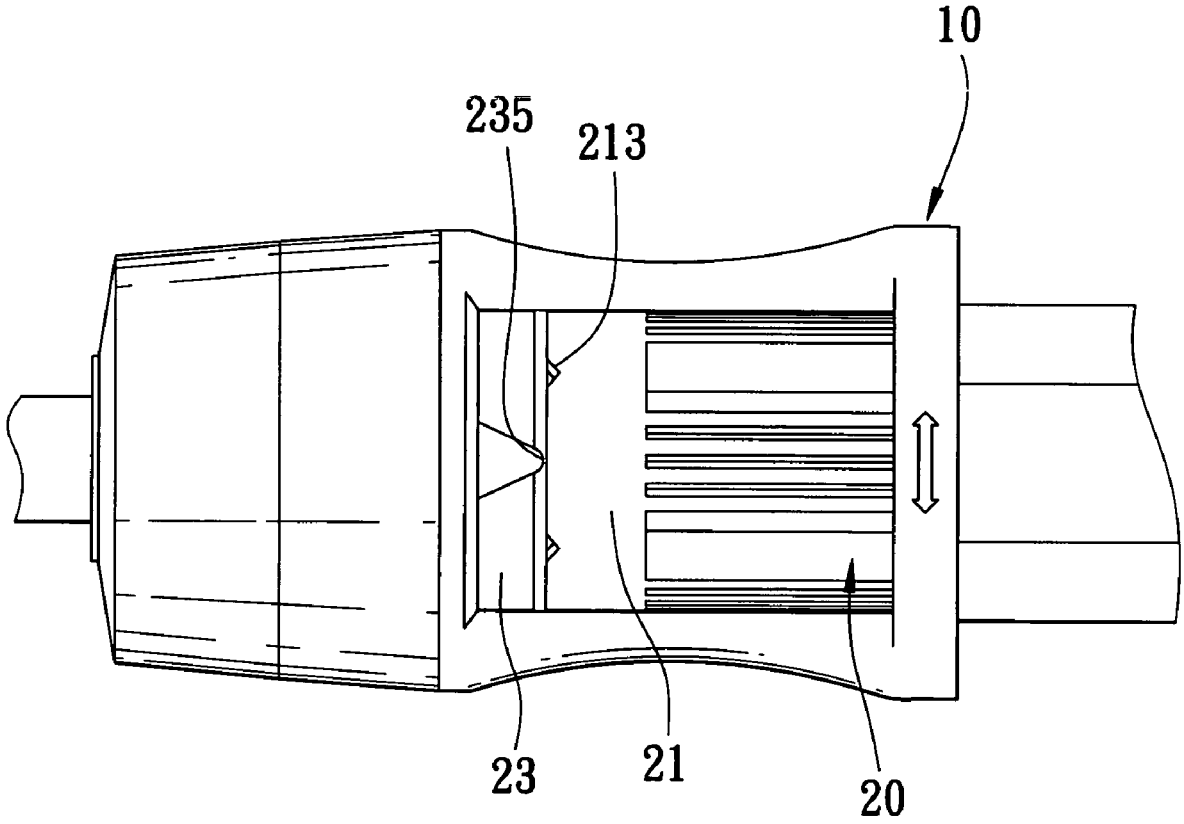
FIG. 13 is a fragmentary top view of the first preferred embodiment, illustrating how the positioning projection of the front seat is disengaged from the positioning grooves in the magazine body.

The driving rod 30 is movable in the screwdriver body 10 between a front limit position shown in FIG. 4 and a rear limit position shown in FIG. 10. In the front limit position, the handle 40 abuts against the front seat 12, and the selected bit 22 is moved by the driving rod 30 from the corresponding bit slot 212 into the bit-engaging hole 732 in the ratchet wheel 73 to thereby project from the ratchet wheel 73. In the rear limit position, the positioning retainer 52 engages the positioning groove 34 in the driving rod 30, and all of the bits 22 are disposed entirely within the magazine body 21. In this state, the driving rod 30 is disposed outwardly of the magazine body 21. Thus, the magazine body 21 can be rotated manually within the magazine-accommodating space 15 in the screwdriver body 10 so as to change the bit 22 to be selected, as shown in FIG. 13. Also in this state, the pushing block 61 can be pressed so as to move the retaining portion 236 of the shaft seat 23 along the guide slot 156 and so as to remove the magazine body 21 from the projection 157, thereby ejecting the magazine body 21 and the shaft seat 23 from the magazine-accommodating space 15. This allows the bit magazine unit 20 to be replaced.

This embodiment has the following advantages:

1. The bit magazine unit 20 can be replaced. Furthermore, to perform such replacement of the bit magazine unit 20, it is only necessary to pull the handle 40 rearwardly and press the pushing block 61, thereby resulting in an easy and speedy magazine-replacing process.
2. Because the bits 22 are confined within a surrounding wall 210 (see FIG. 5) of the magazine body 21, inadvertent removal of the bits 22 from the magazine body 21 can be prevented.
3. Because current screwdriver bits are made of metal that can be attracted magnetically by the member 33, they can be utilized in this embodiment to serve as the bits 22.
4. When it is desired to place one of the bits 22 in position to perform a screw driving operation, the driving rod 30 is moved between the front and rear limits position. This results in an easy and speedy bit-changing process.
5. By controlling the ratchet unit 70, a torque can be applied to the screwdriver in only one direction.

It is noted that the driving portion 762, one of the first and second pawls 74, and the corresponding resilient member 75 can be omitted. As such, the screw driving operation of the screwdriver may be performed in only one direction.

Figure 19:
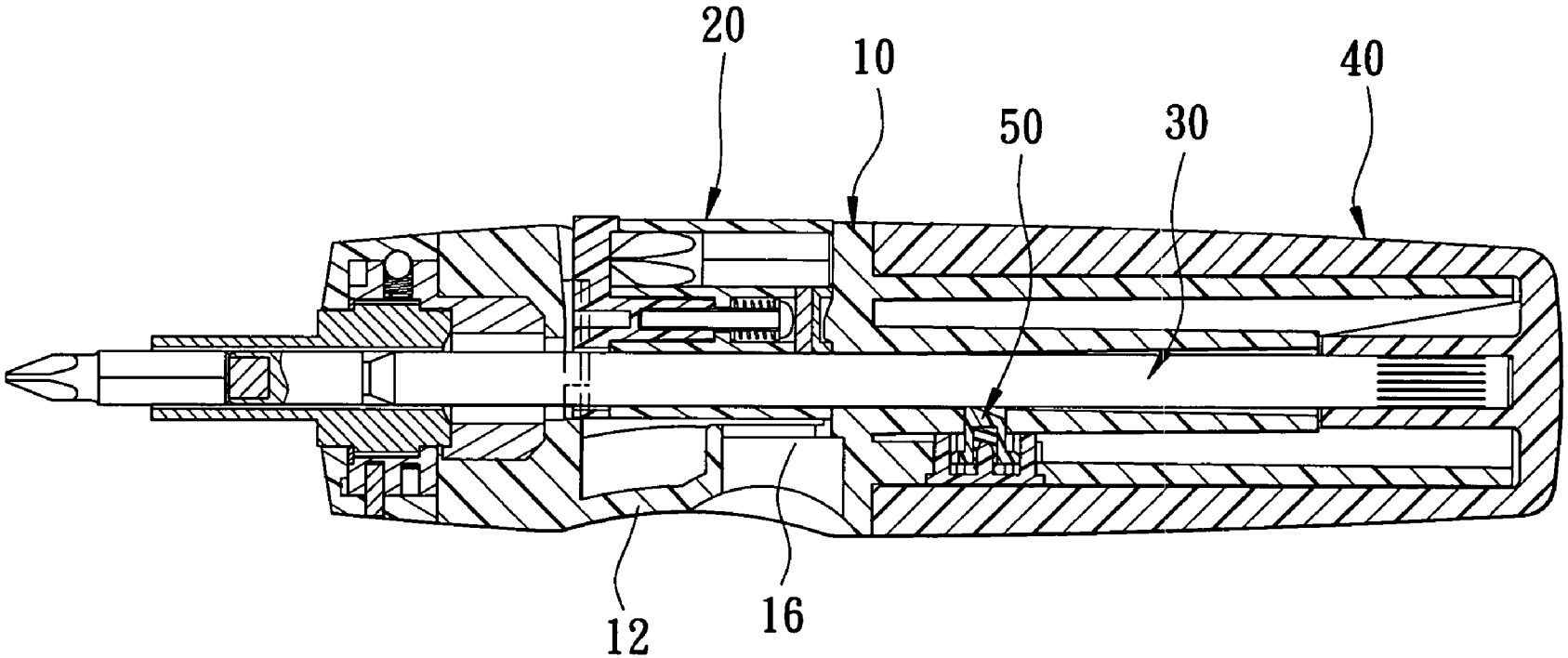
FIG. 19 is a sectional view of the second preferred embodiment of a ratchet screwdriver according to this invention.
Figure 20:
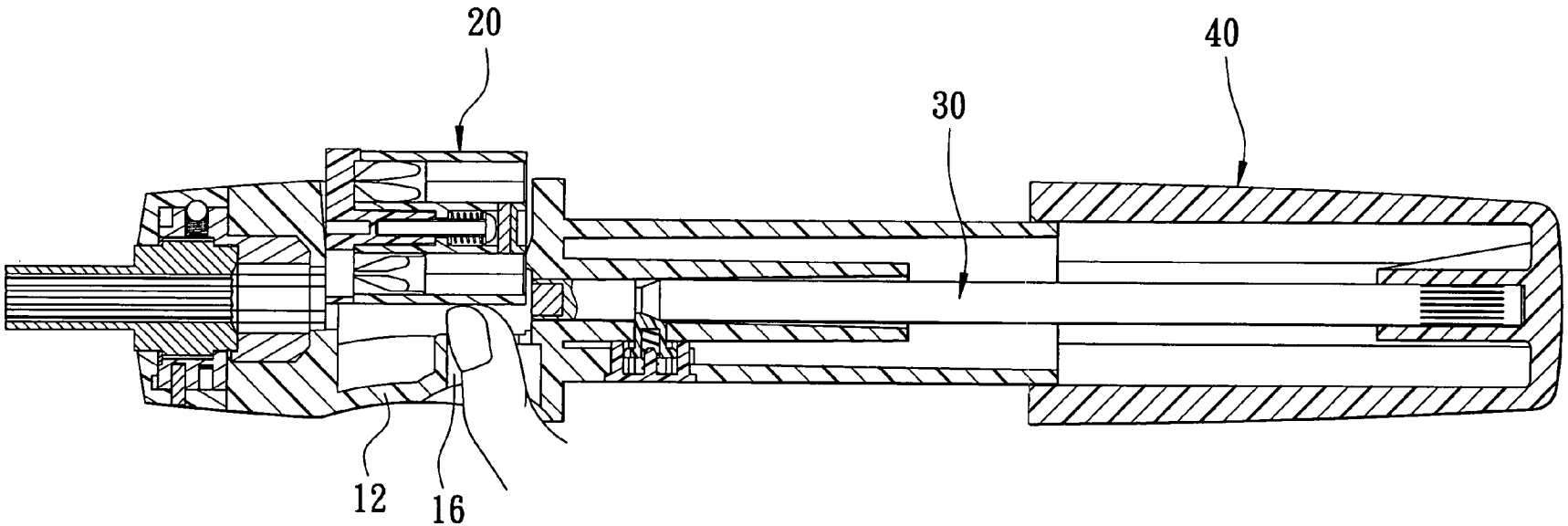
FIG. 20 is a sectional view of the second preferred embodiment, illustrating how a bit magazine unit is ejected manually from an accommodating space in a screwdriver body.

FIGS. 19 and 20 show the second preferred embodiment of a ratchet screwdriver according to this invention, which is similar in construction to the first preferred embodiment except for omission of the pushbutton unit 60 (see FIG. 3). In this embodiment, when it is desired to remove the bit magazine unit 20 from the screwdriver body 10, the driving rod 30 is moved from the front limit position shown in FIG. 18 to the rear limit position shown in FIG. 19. Subsequently, a finger is extended through the through hole 16 so as to eject the bit magazine unit 20 from the screwdriver body 10.

With this invention thus explained, it is apparent that numerous modifications and variations can be made without departing from the scope and spirit of this invention. It is therefore intended that this invention be limited only as indicated by the appended claims.

I claim:

1. A ratchet screwdriver comprising:

a screwdriver body extending along a screwdriver axis and having a rear end that is formed with a guide tube, a front end that is formed with a front seat connected fixedly to said guide tube, and an axial hole formed in said guide tube and extending into said front seat, said front seat having a magazine-accommodating space that is communicated with said axial hole and that is disposed in front of said guide tube;

a bit magazine unit disposed removably within said magazine-accommodating space and including a magazine body extending along a magazine axis and journalled within said magazine-accommodating space, said magazine axis being parallel to said screwdriver axis, said magazine body having a plurality of axially extending bit slots that are formed therethrough and that are disposed around said magazine axis, a selected one of said bit slots being aligned with said axial hole in said screwdriver body, and a plurality of bits received respectively within said bit slots in said screwdriver body;

a driving rod disposed movably axially within said axial hole in said screwdriver body and including a driving end projecting rearwardly from said guide tube, and a bit-coupling end opposite to said driving end, a magnetically attracting member disposed fixedly on said bit-coupling end and attached magnetically to a rear end of a corresponding one of said bits disposed within said selected one of said bit slots in said magazine body, said driving rod being movable relative to said screwdriver body between a front limit position, where the corresponding one of said bits is ejected from said selected one of said bit slots for performing a screwdriving operation, and a rear limit position, where the corresponding one of said bits is received entirely within said selected one of said bit slots; and a ratchet unit disposed on said front seat and disposed in front of said magazine-accommodating space in said front seat, said ratchet unit including a positioning seat disposed fixedly within said front seat, a ratchet wheel journalled within said positioning seat and rotatable about said screwdriver axis, said ratchet wheel having a plurality of ratchet teeth, and a bit-engaging hole communicated with said magazine-accommodating space in said front seat and engaging the corresponding one of said bits such that rotation of the corresponding one of said bits within said bit-engaging hole is prevented when said driving rod is disposed at said front limit position, a first pawl disposed between said positioning seat and said ratchet wheel and having a plurality of retaining teeth, a first resilient member for biasing said retaining teeth of said first pawl toward said ratchet teeth of said ratchet wheel, and a rotary cover disposed on said positioning seat so as to retain said ratchet wheel, said first pawl and said first resilient member on said positioning seat, said rotary cover being operable to remove said retaining teeth of said first pawl from said ratchet teeth of said ratchet wheel;

wherein said ratchet unit further includes a second pawl having a plurality of retaining teeth, and a second resilient member for biasing said retaining teeth of said second pawl toward said ratchet teeth of said ratchet wheel, wherein engagement between said retaining teeth of said first pawl and said ratchet teeth of said ratchet wheel allowing for co-rotation of said ratchet wheel and said screwdriver body in a direction, and wherein engagement between said retaining teeth of said second pawl and said ratchet teeth of said ratchet wheel allowing for co-rotation of said ratchet wheel and said screwdriver in an opposite direction;

wherein said rotary cover has a driving portion that is in slidable contact with said first and second pawls, said rotary cover being operable so that said driving portion of said rotary cover rotates each of said first and second pawls to change from an engagement position to a disengagement position, said driving portion having an annular outer surface that is eccentric with respect to said screwdriver axis and that has a pushing section and a release section, which is located nearer to said screwdriver axis than said pushing section, each of said first and second pawls being disposed at said engagement position so as to engage said retaining teeth of a corresponding one of said first and second pawls with said ratchet teeth of said ratchet wheel when said release section of said annular outer surface of said driving portion of said rotary cover comes into contact with the corresponding one of said first and second pawls, each of said first and second pawls being disposed at said disengagement position so as to remove said retaining teeth of the corresponding one of said first and second pawls from said ratchet teeth of said ratchet wheel when said pushing section of said annular outer surface of said driving portion of said rotary cover comes into contact with the corresponding one of said first and second pawls;

wherein said positioning seat has a stepped hole, said stepped hole having a small-diameter portion disposed in proximity to said magazine-accommodating space in said front seat, and a large-diameter portion disposed in front of said small-diameter portion and having a diameter greater than that of said small-diameter portion, said positioning seat further having a shoulder disposed between said small-diameter and large-diameter portions of said stepped hole, said ratchet wheel being disposed within said large-diameter portion of said stepped hole in said positioning seat, said shoulder being formed with two first pivot holes, said positioning seat further having a front end surface that is formed with a recess, said ratchet unit further including a position-limiting plate that is fitted within said recess in said front end surface of said positioning seat and that is sleeved rotatably on said ratchet wheel, said position-limiting plate being formed with two second pivot holes aligned respectively with said first pivot holes in said shoulder of said positioning seat, each of said first and second pawls further having front and rear sides, each of said first and second pawls further having a first pin that is formed integrally with said rear side of a corresponding one of said first and second pawls and that is disposed rotatably within a corresponding one of said first pivot holes in said shoulder of said positioning seat, and a second pin that is formed integrally with said front side of the corresponding one of said first and second pawls and that is disposed rotatably within a corresponding one of said second pivot holes in said position-limiting plate.

2. The ratchet screwdriver as claimed in claim 1, wherein said ratchet unit further includes a cover-positioning unit, said cover-positioning unit including a spring-biased retainer disposed on said positioning seat, said rotary cover further having at least two positioning holes and being rotatable on said positioning seat so as to engage said spring-biased retainer with a selected one of said positioning holes.

3. The ratchet screwdriver as claimed in claim 1, further comprising a handle that is coupled fixedly to said driving end of said driving rod and that has a surrounding wall, and a non-circular hole defined by said surrounding wall and engaging fittingly said guide tube of said screwdriver body so as to allow for axial movement of said handle relative to said screwdriver body while preventing rotation of said handle relative to said screwdriver body.

4. The ratchet screwdriver as claimed in claim 1, wherein said bit-coupling end of said driving rod is formed with a positioning groove, said ratchet screwdriver further comprising a spring-biased positioning retainer disposed on said guide tube, said spring-biased positioning retainer being biased to engage said positioning groove in said driving rod when said driving rod is disposed at said rear limit position.

5. The ratchet screwdriver as claimed in claim 4, further comprising a fixed block disposed in said guide tube, and a spring disposed between said positioning retainer and said fixed block so as to bias said positioning retainer to move away from said fixed block toward said screwdriver axis.

6. The ratchet screwdriver as claimed in claim 4, wherein said front seat has an outer surface that is formed with a through hole communicated with said magazine-accommodating space.

7. The ratchet screwdriver as claimed in claim 6, further comprising a pushbutton unit that is operable to eject said magazine body from said magazine-accommodating space when said driving rod is disposed at said rear limit position.

8. The ratchet screwdriver as claimed in claim 7, wherein said pushbutton unit includes:

a pushing block disposed movably within said through hole in said front seat and movable between a pushing position, where said magazine body is ejected from said magazine-accommodating space by said pushing block, and a release position, where said pushing block is removed from said magazine body; and a spring for biasing said pushing block toward said release position.

9. A ratchet screwdriver comprising:

a screwdriver body extending along a screwdriver axis and having a rear end that is formed with a guide tube, a front end that is formed with a front seat connected fixedly to said guide tube, and an axial hole formed in said guide tube and extending into said front seat, said front seat having a magazine-accommodating space that is communicated with said axial hole and that is disposed in front of said guide tube;

a bit magazine unit disposed removably within said magazine-accommodating space and including a magazine body extending along a magazine axis and journalled within said magazine-accommodating space, said magazine axis being parallel to said screwdriver axis, said magazine body having a plurality of axially extending bit slots that are formed therethrough and that are disposed around said magazine axis, a selected one of said bit slots being aligned with said axial hole in said screwdriver body, and a plurality of bits received respectively within said bit slots in said screwdriver body;

a driving rod disposed movably axially within said axial hole in said screwdriver body and including a driving end projecting rearwardly from said guide tube, and a bit-coupling end opposite to said driving end, a magnetically attracting member disposed fixedly on said bit-coupling end and attached magnetically to a rear end of a corresponding one of said bits disposed within said selected one of said bit slots in said magazine body, said driving rod being movable relative to said screwdriver body between a front limit position, where the corresponding one of said bits is ejected from said selected one of said bit slots for performing a screwdriving operation, and a rear limit position, where the corresponding one of said bits is received entirely within said selected one of said bit slots; and a ratchet unit disposed on said front seat and disposed in front of said magazine-accommodating space in said front seat, said ratchet unit including a positioning seat disposed fixedly within said front seat, a ratchet wheel journalled within said positioning seat and rotatable about said screwdriver axis, said ratchet wheel having a plurality of ratchet teeth, and a bit-engaging hole communicated with said magazine-accommodating space in said front seat and engaging the corresponding one of said bits such that rotation of the corresponding one of said bits within said bit-engaging hole is prevented when said driving rod is disposed at said front limit position, a first pawl disposed between said positioning seat and said ratchet wheel and having a plurality of retaining teeth, a first resilient member for biasing said retaining teeth of said first pawl toward said ratchet teeth of said ratchet wheel, and a rotary cover disposed on said positioning seat so as to retain said ratchet wheel, said first pawl and said first resilient member on said positioning seat, said rotary cover being operable to remove said retaining teeth of said first pawl from said ratchet teeth of said ratchet wheel;

wherein said magazine body has a front end surface that is formed with a plurality of angularly equidistant positioning grooves, an axially extending central hole that is formed through said magazine body, and a flange extending radially and inwardly therefrom so that said central hole is divided into a front hole portion disposed in front of said flange, and a rear hole portion disposed behind said flange, said bit magazine unit further including a shaft seat, said shaft seat including:

a disc portion disposed removably on said front seat and perpendicular to said screwdriver axis and said magazine axis, said disc portion being formed with a positioning projection engaging a selected one of said positioning grooves in said front end surface of said magazine body;

a shaft rod extending integrally from a central portion of said disc portion into said front hole portion of said central hole in said magazine body along said magazine axis and having a rear end surface that is formed with a threaded hole;

a bolt engaging said threaded hole in said shaft rod and having a head at a rear end of said bolt, said head being disposed in said rear hole portion of said central hole in said magazine body; and a coiled compression spring sleeved on said bolt between said flange and said head of said bolt so as to bias said positioning projection of said disc portion to engage said selected one of said positioning grooves.

10. The ratchet screwdriver as claimed in claim 9, wherein said bit magazine unit further includes a magnet disposed in said central hole in said magazine body so as to magnetically attract said bits disposed within said bit slots in said magazine body, thereby confining said bits within said magazine body.

11. The ratchet screwdriver as claimed in claim 9, wherein said magazine-accommodating space in said magazine body is defined by a pair of front and rear side surfaces perpendicular to said screwdriver axis, a pair of left and right side surfaces parallel to said screwdriver axis, and a curved bottom surface, said front side surface being formed with an open-ended guide slot, said disc portion being formed with a retaining portion engaging fittingly said guide slot in said front side surface, said rear side surface being formed with a protrusion engaging a rear end of said central hole in said magazine body so as to position said magazine body on said rear side surface, said magazine body being removable forcibly from said protrusion when said driving rod is disposed at said rear limit position.

* * * * *